US007608003B1

(12) United States Patent
Fusco et al.

(10) Patent No.: US 7,608,003 B1
(45) Date of Patent: Oct. 27, 2009

(54) GAME BALL

(75) Inventors: Michael T. Fusco, Johnston, RI (US); James R. Gunderson, Lakeville, MN (US); Timothy R. Wilding, Somerset, MA (US)

(73) Assignee: Little Kids, Inc., Providence, RI (US)

( * ) Notice: Subject to any disclaimer, the term of this patent is extended or adjusted under 35 U.S.C. 154(b) by 505 days.

(21) Appl. No.: 11/353,347

(22) Filed: Feb. 14, 2006

Related U.S. Application Data

(60) Provisional application No. 60/653,470, filed on Feb. 16, 2005.

(51) Int. Cl.
*A63B 39/08* (2006.01)

(52) U.S. Cl. ..... 473/613

(58) Field of Classification Search ..... 473/612, 473/613, 571, 594, 595; 119/702–709; 426/77–84
See application file for complete search history.

(56) References Cited

U.S. PATENT DOCUMENTS

| | | | | | |
|---|---|---|---|---|---|
| 922,773 | A | | 5/1909 | Kempshall | |
| 1,150,761 | A | | 8/1915 | Hartman | |
| 1,789,333 | A | * | 1/1931 | Da Costa | 473/571 |
| 2,135,210 | A | | 11/1938 | Farrar | |
| 2,219,154 | A | * | 10/1940 | Wahlberg | 473/594 |
| 2,776,139 | A | | 1/1957 | Blamey, Jr. et al. | |
| 3,706,140 | A | * | 12/1972 | Brillaud et al. | 34/60 |
| 3,874,663 | A | | 4/1975 | Kahle | |
| 4,128,238 | A | | 12/1978 | Newcomb et al. | |
| 4,184,682 | A | | 1/1980 | Collins et al. | |
| 4,286,783 | A | | 9/1981 | Newcomb et al. | |
| D287,988 | S | * | 1/1987 | Billinghurst | D21/713 |
| 4,871,169 | A | | 10/1989 | Autorino et al. | |
| 4,874,169 | A | | 10/1989 | Litchfield | |
| 4,919,422 | A | | 4/1990 | Ma | |
| 4,930,776 | A | * | 6/1990 | Newcomb et al. | 473/570 |
| 5,033,743 | A | | 7/1991 | Wright | |
| D322,105 | S | | 12/1991 | Ma | |
| 5,072,938 | A | | 12/1991 | Shin | |
| 5,123,659 | A | | 6/1992 | Williams | |
| 5,133,550 | A | | 7/1992 | Handy | |
| 5,158,284 | A | | 10/1992 | Vogl | |
| 5,228,687 | A | * | 7/1993 | Luecke et al. | 473/596 |
| 5,280,906 | A | * | 1/1994 | Vitale | 473/613 |
| 5,460,368 | A | | 10/1995 | Pearson | |
| 5,676,611 | A | | 10/1997 | Foster et al. | |
| D386,548 | S | | 11/1997 | Cullen, III | |
| 5,768,917 | A | * | 6/1998 | Freida | 206/0.5 |
| 5,819,690 | A | | 10/1998 | Brown | |
| 5,820,495 | A | | 10/1998 | Howland | |
| 5,833,548 | A | | 11/1998 | Ellis et al. | |
| 6,093,118 | A | | 7/2000 | Simpson | |
| 6,261,197 | B1 | | 7/2001 | Grechko | |
| 6,264,574 | B1 | | 7/2001 | Nelson et al. | |
| D459,404 | S | | 6/2002 | Perez | |
| 6,609,944 | B1 | * | 8/2003 | Viola | 473/595 |
| 6,935,274 | B1 | * | 8/2005 | Rothschild | 119/702 |
| 7,367,283 | B2 | * | 5/2008 | Aboujaoude et al. | 119/707 |
| 2003/0027672 | A1 | * | 2/2003 | Leal et al. | 473/613 |

* cited by examiner

*Primary Examiner*—Steven Wong

(57) ABSTRACT

A game ball comprising a generally spherical shell having a plurality of adjustable apertures to assist the user in varying the flight path of the game ball. The game ball also may have, in combination with adjustable apertures, surface modification causing drag to assist the user in varying the flight path of the game ball.

16 Claims, 15 Drawing Sheets

53
51
59
Sect: B-B 51
59
Sect: A-A

69

65
53
91
A
B
A
B
68
63
64
69
66
67
70
51

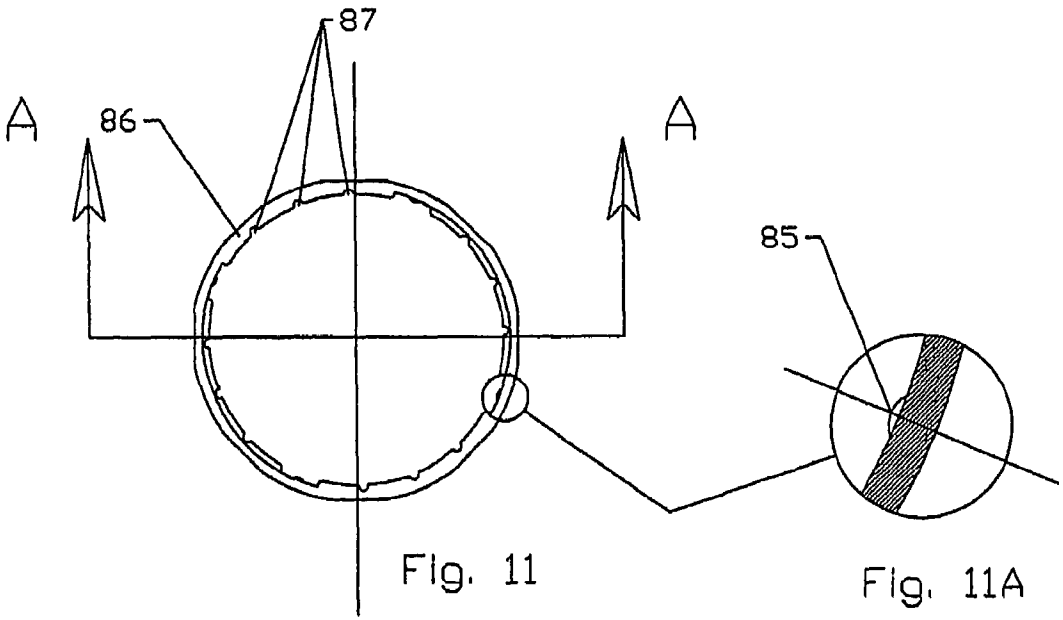
Fig. 11
Fig. 11A
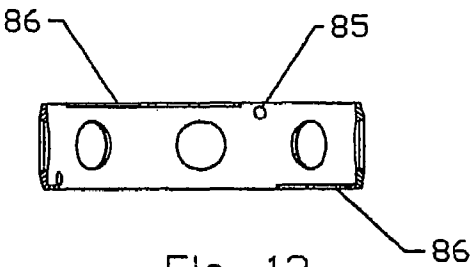
Fig. 12
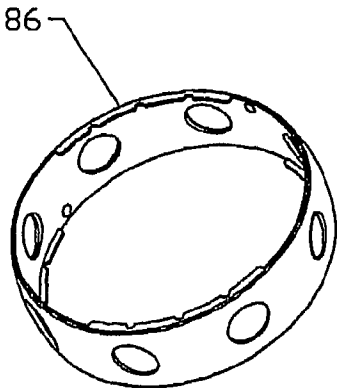
Fig. 10

GAME BALL

Applicants claim priority based on U.S. Provisional Patent Application Ser. No. 60/653,470, titled Game Ball, filed Feb. 16, 2005.

BACKGROUND

Game balls are balls of a variety of shapes and sizes used to practice and play games. A baseball is a common game ball used by professionals and amateurs alike. Baseball professionals, especially pitchers, practice many years to throw baseballs with the desired flight path. Pitchers typically throw fast balls, curve balls, sliders, knuckleballs, and other pitches in attempts to prevent a batter from hitting the ball. Amateurs imitate these attempts, but frequently lack the training and experience necessary to throw these various pitches effectively.

Game balls having lightweight hollow spheres, usually made of plastic, have enabled less experienced players to throw professional style pitches. Fixed apertures have been added to slow the ball, and to vary the flight path. Some lightweight game balls have surface modifications to affect flight path. The surface modifications generally induce air resistance, causing drag, which results in the game ball deviating from a flight path it would have followed in the absence of the drag.

No known game ball has adjustable apertures, or combines adjustable apertures and surface modifications producing drag, to allow the user to throw a game ball with flight paths that vary to imitate professional pitches.

SUMMARY OF INVENTION

The present invention is directed to a device that satisfies the need for an improved game ball that allows the user to imitate a variety of pitches with little experience or expertise. A game ball having features of the present invention comprises a shell having adjustable apertures. In one embodiment, the adjustable apertures are adjusted using a ring having ring openings. The ring is moveably attached to the shell so that the ring can be moved on the sphere to align, in part or in whole, the shell apertures and the ring openings. When the shell apertures and ring openings are fully aligned, the adjustable apertures are fully opened, and when the shell apertures and ring openings are not aligned, the adjustable apertures vary from partially to completely closed.

The adjustable aperture feature also can be combined with a variety of surface modifications producing drag to allow the user to throw a variety of pitches or flight paths with little or no experience.

Further features and advantages of the present invention will become apparent to those of ordinary skill in the art in view of the detailed description of preferred embodiments which follows, when considered together with the attached drawings and claims.

BRIEF DESCRIPTION OF THE DRAWINGS

FIG. 10 is a perspective view of a game ball ring with retaining ribs;

FIG. 11 is a top view of a game ball ring with retaining ribs;

FIG. 11A is an enlarged view of a locking protrusion shown in FIG. 8;

FIG. 12 is a cross-sectional view of a game ball ring along the A-A line in FIG. 10;

DETAILED DESCRIPTION OF THE PREFERRED EMBODIMENT

Figure 1:
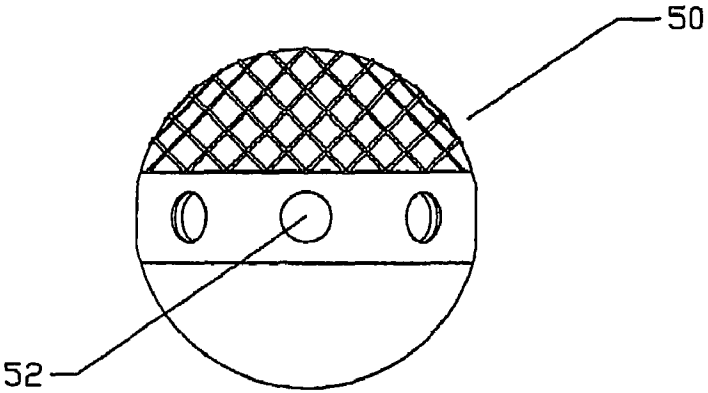
FIG. 1 is a side view of a game ball.

The game ball 50 comprises a generally spherical hollow shell 51, and one or more adjustable apertures 52. The shell has an equator 54, an axis 55 and two opposing poles 56 & 57. The shell also has a shell wall 58, which defines a shell interior 59 and a shell exterior 60, and the shell wall has an inner surface 61 and an outer surface 62. The shell outer surface has an adjustable aperture portion 63 and may have a smooth portion 64, and an irregular portion 65 having surface modifications.

Shell apertures are openings, open spaces or holes in, or penetrations through the shell wall permitting air communication through the shell wall. As used in this description, the term "adjustable apertures" refers collectively to the shell apertures and the component or element that makes the shell apertures adjustable, such as the ring 80, with its ring openings 81. The game ball is "adjustable" in the sense that the user can manipulate the game ball so that the shell apertures are partially or completely open or closed. "Closed" means that the shell aperture is substantially covered by a portion of the game ball, such as the ring.

Figure 3:
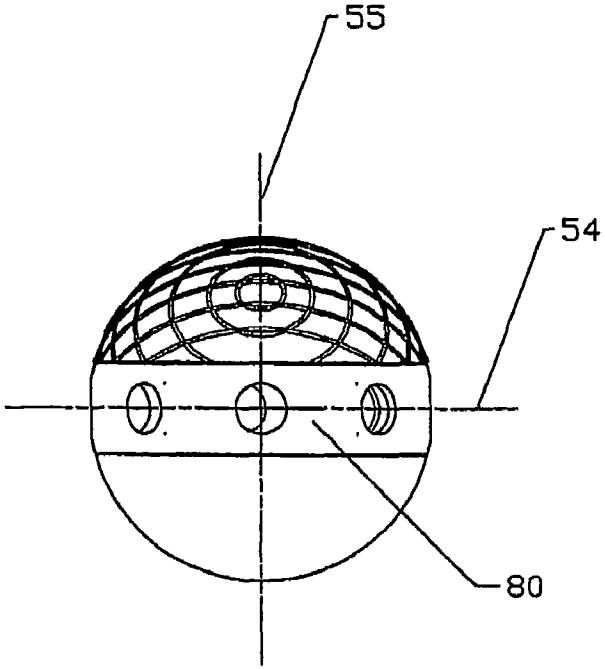
FIG. 3 is an alternative side view of a game ball.
Figure 2:
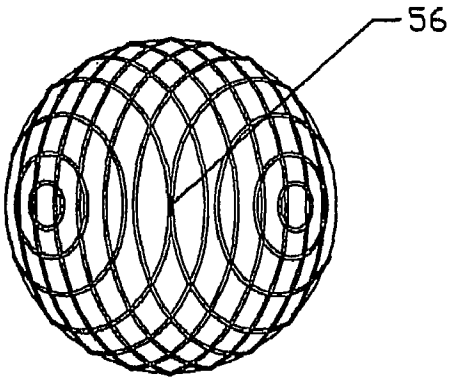
FIG. 2 is a top view of a game ball.
Figures 4, 4A, 5, 6, 6A:
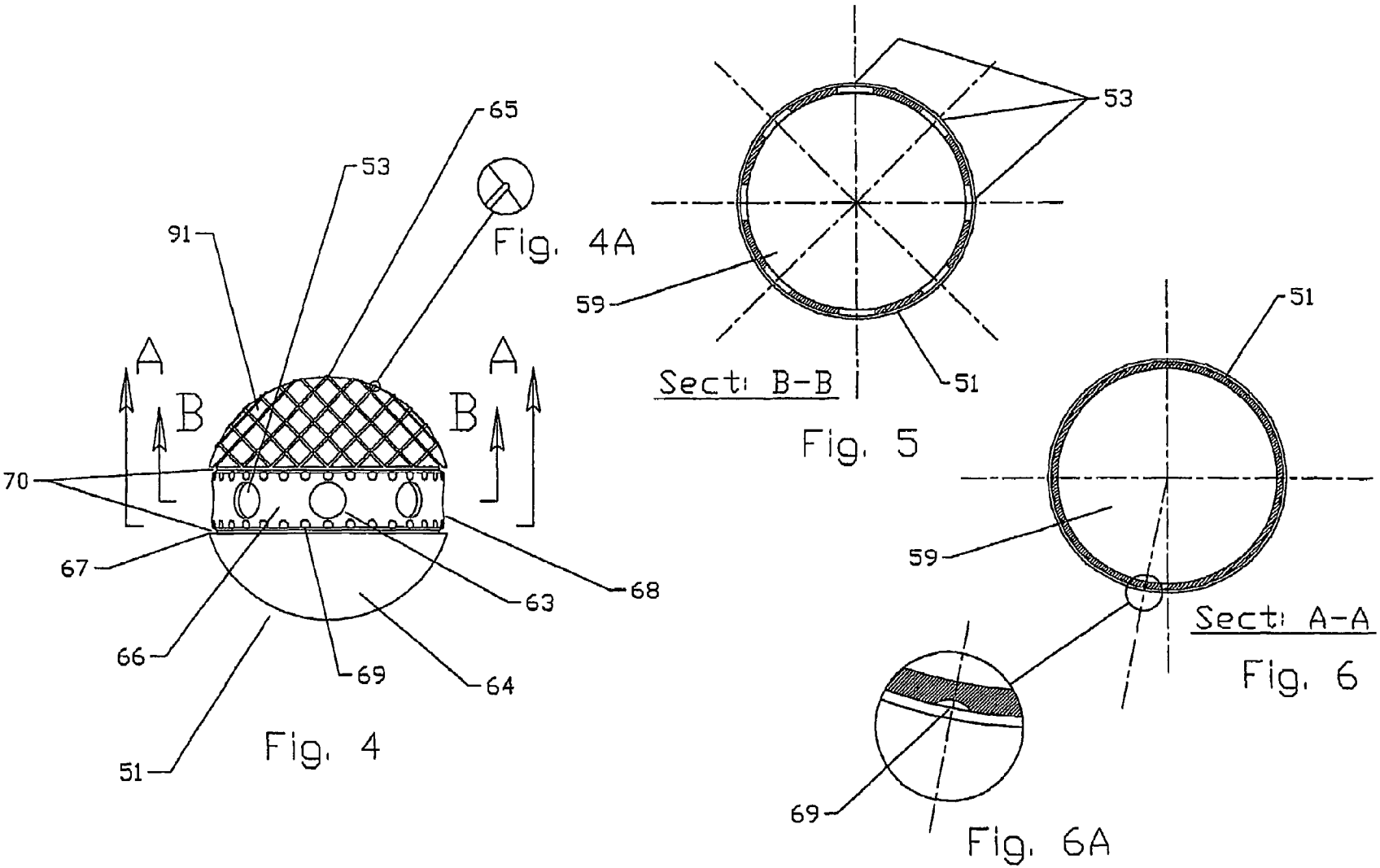
FIG. 4 is a side view of a game ball shell.
FIG. 4A is an enlarged view of an arced line.
FIG. 5 is a top sectional view of a shell along the B-B line in FIG. 4.
FIG. 6 is a top sectional view of a shell along the A-A line in FIG. 4.
FIG. 6A is an enlarged view of a locking detent in FIG. 6.
Figures 17, 18, 18A, 19, 19A:
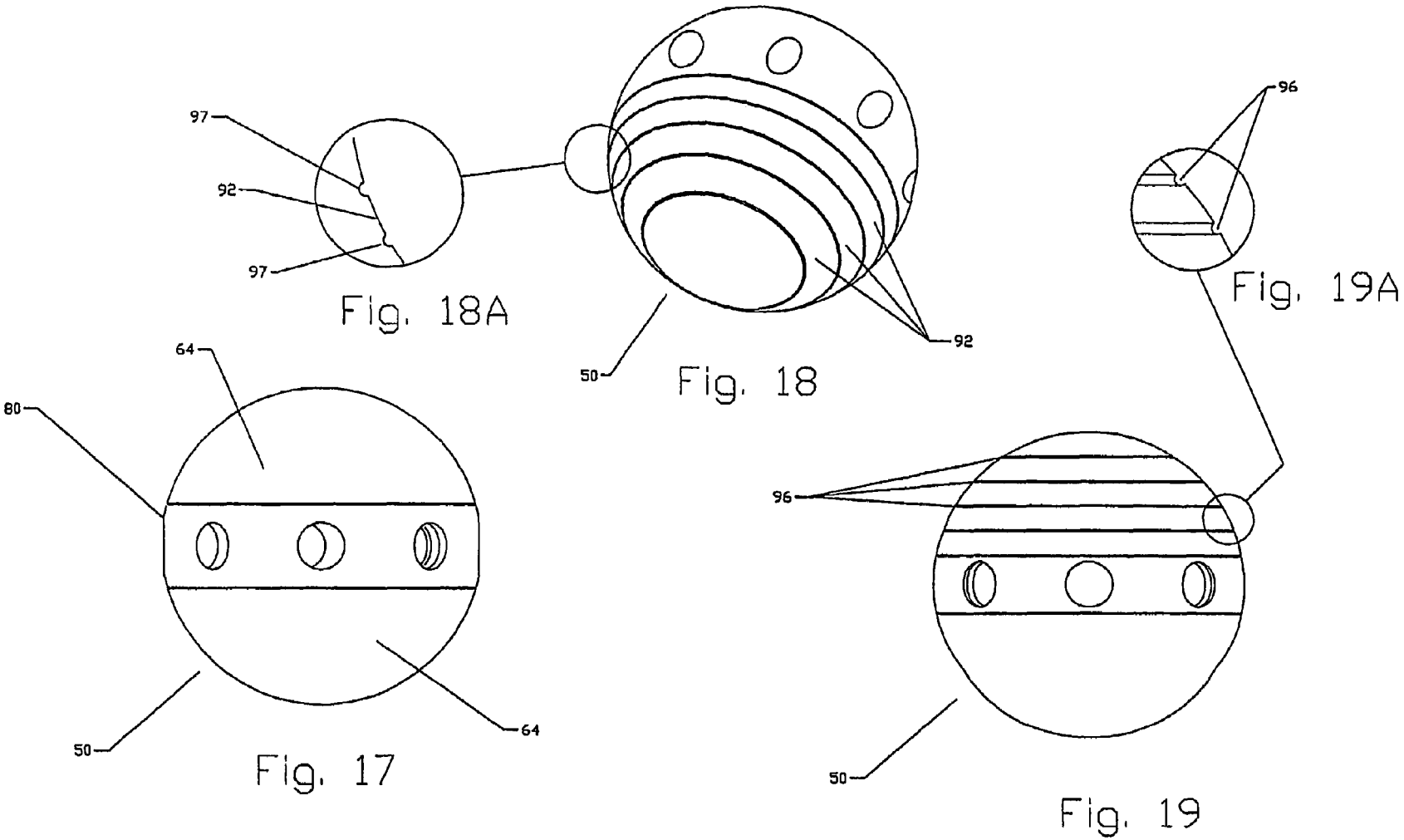
FIG. 17 is a perspective view of an alternative game ball without surface modifications.
FIG. 18 is a perspective view of a game ball with parallel surface modifications.
FIG. 18A is an enlarged view of an air channel ridge in FIG. 18.
FIG. 19 is a side view of a game ball with parallel surface modifications.
FIG. 19A is an enlarged view of a groove in FIG. 19.

In the embodiment shown in FIGS. 1-3, the generally spherical shell 51, shown in FIG. 4, includes shell apertures 53 and an indented band 66, in which the shell apertures are located. The indented band 66 is covered by a ring 80, as shown in FIGS. 1, 10 & 17, which ring is sized to fit in the indented band 66 without being dislodged in ordinary use. The ring in this embodiment is sized so that it can rotate about the shell 51. It is not necessary that the ring be able to rotate a full 360° around the shell if it can rotate in both directions around the axis. The ring 80 is generally circular, having ring openings 81, a ring outer surface 82, a ring inner surface 83 and two opposing ring edges 84. The ring should be sized to substantially fill the indented band so that the general spherical shape of the game ball is maintained when the ring is in place, and so that the ring can be rotated by the user to adjust the adjustable apertures. For an approximately 3 inch game ball, the distance between ring edges, as measured across the ring inner surface, is preferably sized approximately 0.02 inches smaller than the size of the indented band 66 between the indented band ledges 67. The ring in the embodiment shown in FIG. 1 is approximately 0.8 inches from ring edge to ring edge, approximately 0.4 inches from ring edge to the center of the ring openings, and approximately 0.10 inches thick, as measured between the ring inner surface 83 and the ring outer surface 82, at a portion of the ring where there are no locking protrusions 85 or retaining ribs 86.

Figure 9:
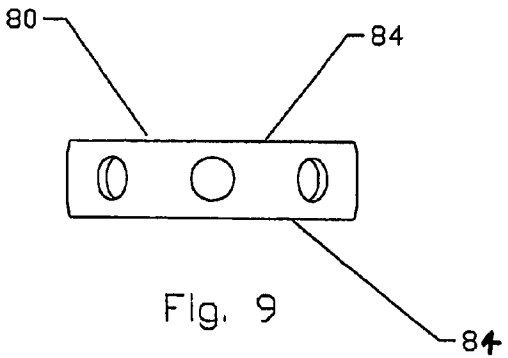
FIG. 9 is a side view of a game ball ring.
Figure 7:
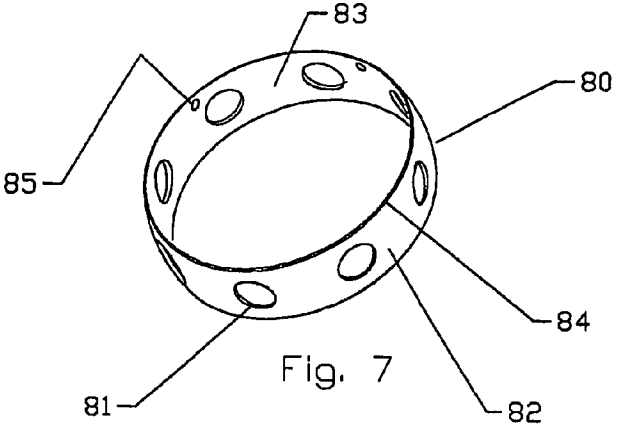
FIG. 7 is a perspective view of a game ball ring.

The ring has ring openings 81, as shown in FIG. 7, preferably in size and number to match the shell apertures 53. The ring is installed in the indented band during manufacture. The user rotates the ring in this embodiment around the shell to vary the amount of the shell apertures that are closed by positioning the ring openings in various positions relative to the shell apertures. When a shell aperture 53 and ring opening 81 are fully aligned, such as with their centers in line with the center of the sphere, the adjustable aperture 52 is open, FIG. 1, and when the ring opening is aligned with a portion of the indented band between the ring openings, the adjustable aperture is closed. The user can adjust in between the open and closed position to vary the size of the adjustable apertures. The ring in FIG. 1 approximately weighs 5.5 grams and is injection molded. Ring openings are approximately 0.4375 inches in diameter in this embodiment. The ring outer surface preferably arced between the ring edges to closely approximate the curvature of the shell, as shown in FIGS. 3 & 9.

Figure 8A:
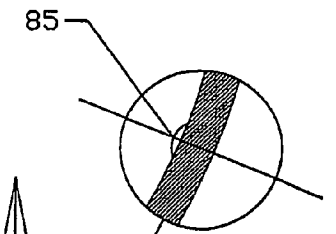
FIG. 8A is an enlarged view of a locking protrusion shown in FIG. 8.
Figure 8:
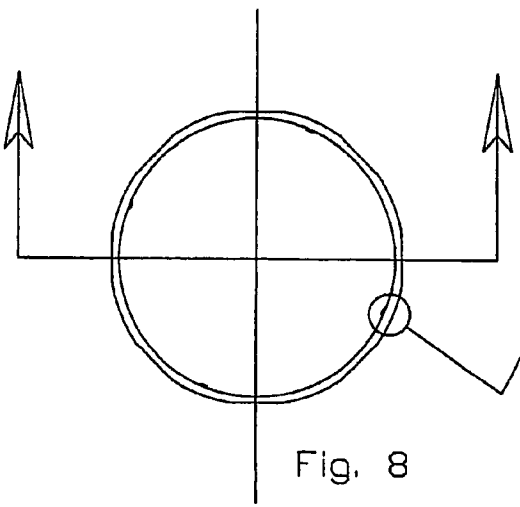
FIG. 8 is a top view of a game ball ring.
Figure 13:
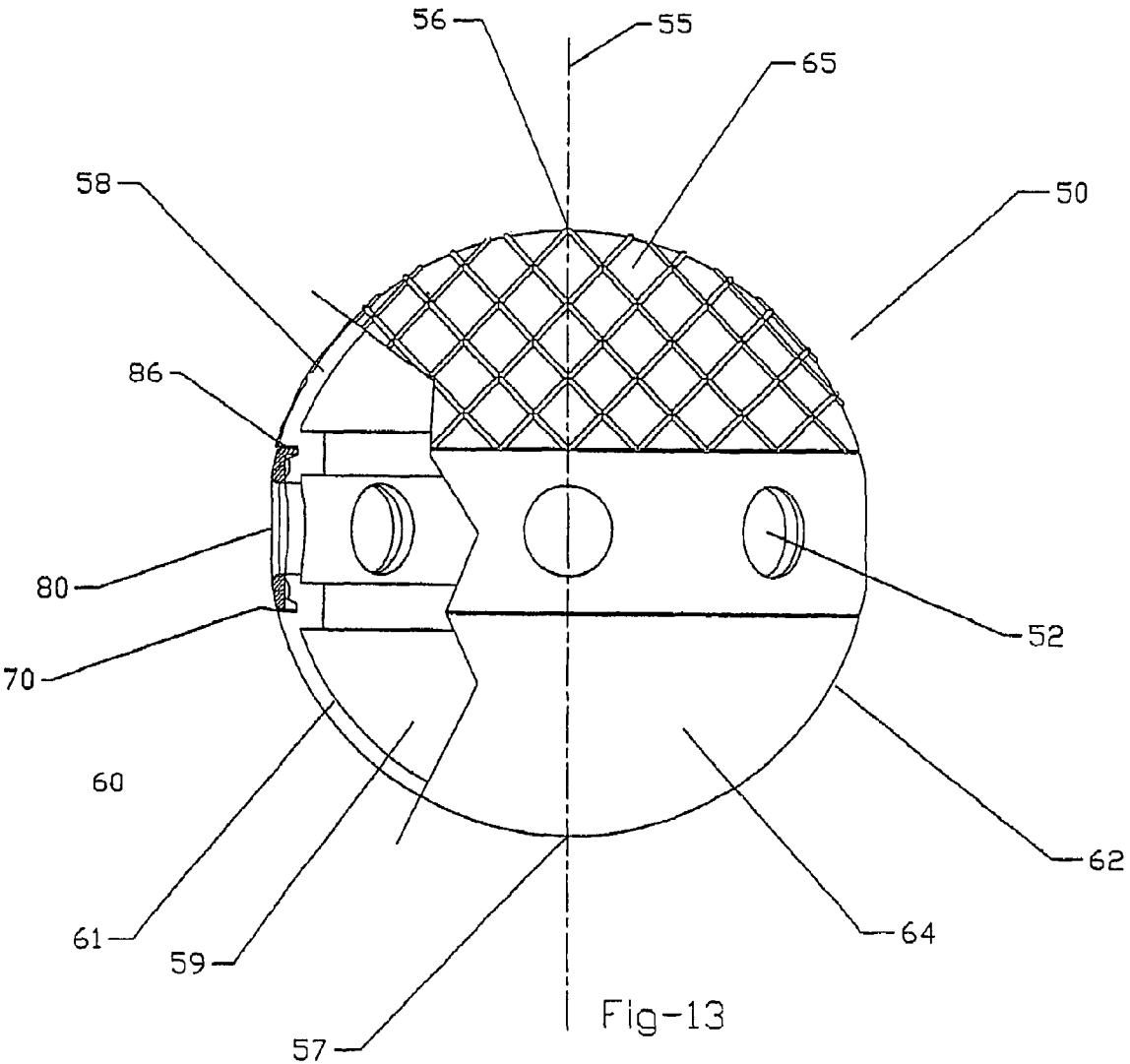
FIG. 13 is a partial cross-section view of a game ball.

The ring can rotate without being locked in a position, or the game ball can have any of a variety of locking features to permit stepped or quantitized rotation. As shown in FIGS. 4 through 8, one locking feature comprises one or more locking detents 69 in the indented band wall 68, FIG. 6A, and complimentary locking protrusions 85, FIG. 8A, in the ring. The locking detents are aligned with the locking protrusions, and they interlock to provide resistance to ring rotation. When the user applies force to rotate the ring, the ring and shell wall deflect slightly to permit the locking protrusion to rotate around the shell. The game ball in FIG. 6A has 32 detents equally spaced around the sphere, each detent being approximately 0.025 inches deep and having a radius of approximately 0.04 inches. The ring is approximately 0.10 inches thick.

An increased number of locking detents decreases the distance the ring rotates before it interlocks with the shell. The locking detents preferably are located on the shell, and the locking protrusions on the ring, but the locking detents could be located on the ring and the locking protrusions on the shell. Locking components could be located on portions of the shell other than the indented band wall, including the indented band ledges 67.

As shown in FIGS. 10 & 11, the ring may have retaining ribs 86 to assist in retaining the ring on the sphere. Retaining ribs 86 fit in retaining rib grooves 70 located on the sphere shell 51 to provide resistance which assists in holding the ring in its rotatably attached relation to the sphere. As shown in FIGS. 10 & 11, each ring edge has a group of retaining ribs positioned approximately 180°, on center, apart from another group of retaining ribs on that edge. The opposing ring edges preferably have the group of retaining ribs offset approximately 90° on center from a group of retaining ribs on the other ring edge. As shown in FIG. 11, the ring has retaining ribs about its circumference, but the retaining ribs preferably are in four groups, and the groups are offset approximately 90° from the next group, and offset to opposite ring edges. This improves the retaining capacity of the retaining ribs, and permits easier molding of the retaining ribs during manufacture. Additionally, the retaining ribs have retaining rib reliefs 87 in between the retaining ribs to reduce stress and assist in preventing cracking or breaking of the retaining ribs or ring. To further improve the ability to mold the rib, locking protrusions 85 can be inserted in the interface between the adjacent groups of retaining ribs, as shown in FIGS. 10 & 11.

Figure 16A:
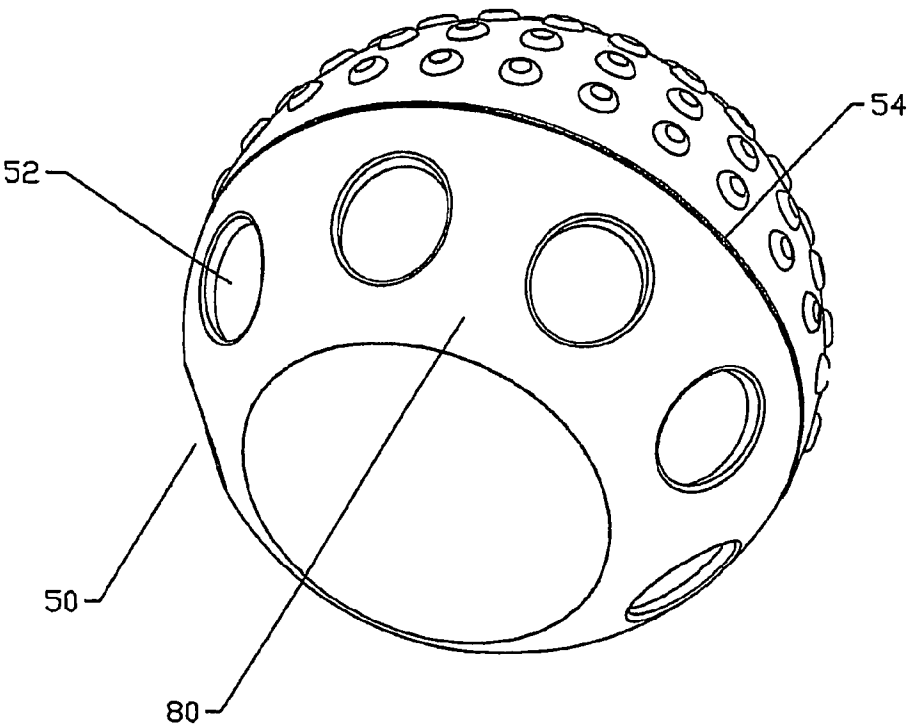
FIG. 16A is a perspective view of an alternative game ball.
Figure 16:
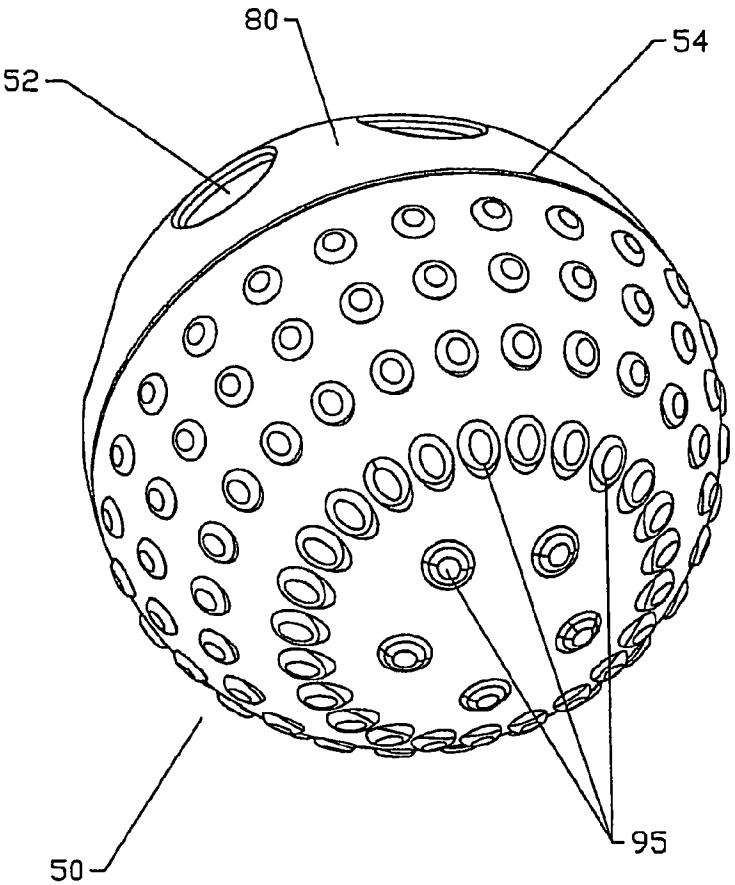
FIG. 16 is a perspective view of an alternative game ball with raised shapes.

The sphere apertures can be located approximately centered along the equator as shown in FIG. 1, or offset from an equator as shown in FIGS. 16 & 18. The apertures can be made adjustable in a variety of ways, as described below.

The number and spacing of adjustable apertures can vary, but may be limited by the manner in which they are adjusted. In the embodiment shown in FIG. 5, there are eight shell apertures spaced approximately evenly around the equator of the shell. When making a game ball approximating the standard sized baseball, which is approximately 3 inches in diameter, and having circular apertures approximately 0.589 inches, and using a rotating ring of FIG. 5, to adjustably open and close the shell apertures, eight shell apertures is preferable, since the total of the diameters of all shell apertures can be no greater than one-half of the circumference of the shell, since the ring opening rotates to a solid portion of the shell when the ring is rotated to close the shell apertures.

It is generally preferable to maximize the total area of the open shell apertures, since the greater the area of the open aperture, the greater the effect on the game ball's flight path. When thrown with the same force, the game ball travels more slowly when the shell apertures are opened, and faster when the shell apertures are closed.

Figure 14:
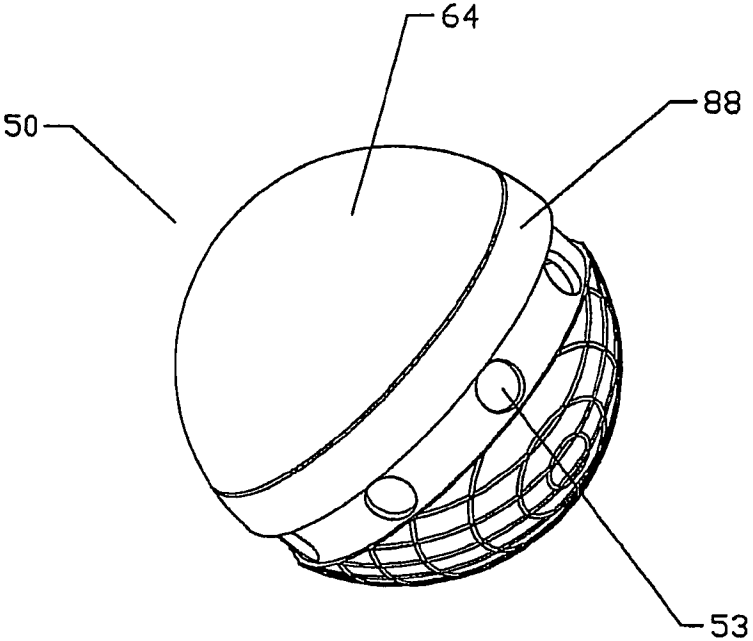
FIG. 14 is perspective view of an alternative game ball with a sliding ring.

In the alternative method of adjusting the adjustable apertures shown in FIG. 14, sphere apertures are located in only a portion of the indented band, preferably less than one-half, and a sliding ring 88 sized to cover the sphere apertures is also located in the indented band. The sliding ring lacks apertures or openings, and adjusts the shell apertures by sliding over the sphere apertures. The sphere apertures can be partially or completely covered by the sliding ring. It is unnecessary for the sliding ring to rotate about the sphere.

Figure 15:
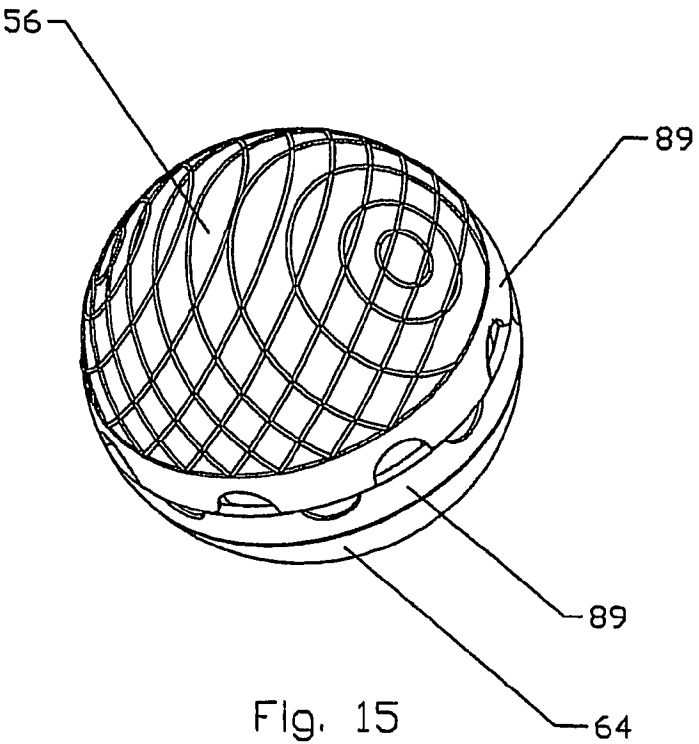
FIG. 15 is a perspective view of an alternative game ball with dual rotating aperture rings.

In the alternative embodiment shown in FIG. 15, the ring is split into multiple ring segments 89 to permit the user to selectively open or close the shell apertures with greater precision and variability. Each ring segment can be rotated independently of each other, and can be rotated to align ring openings with a sphere aperture. Since ring segments can be smaller than rings covering the same space as multiple ring segments, the ring openings in ring segments will be correspondingly smaller, permitting the user to open or close the shell aperture in smaller increments. The game ball shown in FIG. 15 can also use the same locking features described above, including the recessed detents and retaining protrusions.

The game ball generally will be molded plastic, such as polyethylene for the shell and polypropylene for the ring. Other plastics may be used, depending on the characteristics desired in the game ball. The shell preferably is blow molded in one piece, but may be assembled from two or more pieces. The shell preferably weighs approximately 21 grams. In one embodiment the game ball preferably has a diameter of approximately 3", to correspond to baseball size. Larger sizes similar to softballs, or larger or smaller sizes for ease of gripping, hitting, seeing or other use of the game ball, especially by children, can be manufactured.

The game ball having adjustable apertures may have a substantially smooth surface as shown in FIG. 17. The performance of a game ball having adjustable apertures is further enhanced, however, by adding surface modifications causing drag. With such surface modifications, the game ball preferably has a shell irregular portion containing surface modification, a shell smooth portion 64, and an adjustable aperture portion.

There are a variety of surface modifications that produce drag. Surface modifications can be raised above the surface as with ridges, or be depressions in the surface, such as grooves. Surface modifications also can be created by having one surface of a different material with greater drag than the other surface, and with irregular surfaces such as found on a tennis ball.

As shown in FIGS. 1, 2 & 3, a series of arced lines not substantially parallel to the ring edge 84 intersect to produce a grid pattern of air baffles 91, which provides resistance to the air as the ball is thrown, producing drag, which assists novices in throwing professional style pitches. The arced lines preferably are approximately 0.25 inches apart, from center of arced line to center of arced line, and at an angle of approximately 45° from the axis at the ring edge, as shown in FIG. 1. The arced lines are raised above the shell outer surface approximately one-tenth of an inch, and are approximately two-tenths of an inch wide.

As shown in FIGS. 16 & 16A, surface modifications can be in the form of raised shapes 95, which could be substantially circular, oval, elliptical, or other shapes. Manufacturing efficiency makes it preferable to use a plurality of the same raised shapes on a game ball, but the game ball could perform with a variety of different shapes on the same ball.

As shown in FIGS. 18 & 19, the game ball could incorporate known parallel air channels 92, either as grooves 96 in the sphere, FIG. 19A, or between raised air channel ridges 97, oriented substantially parallel to the ring edge 84.

As shown in FIGS. 20 through 29, the surface modifications could be approximately perpendicular ridges 98 or spiral ridges 93 substantially perpendicular to the ring edge 84. The perpendicular ridges can terminate at or near the ring edge, as shown in FIG. 1, extend onto the ring to the ring openings 81 or to the approximate center of the ring openings, as shown in FIGS. 20-29, or cover the entire game ball (not shown).

Figure 22:
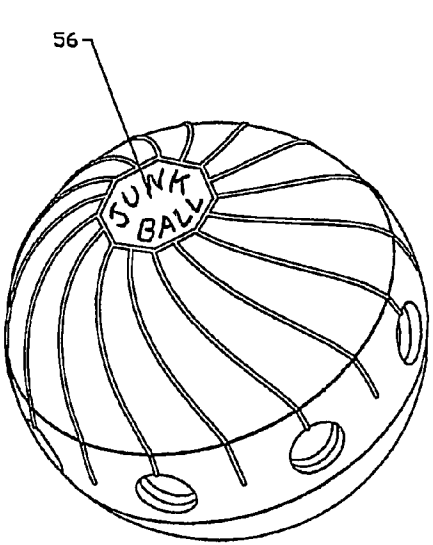
FIG. 22 is a perspective view of an alternative game ball with alternative surface modifications.
Figure 20:
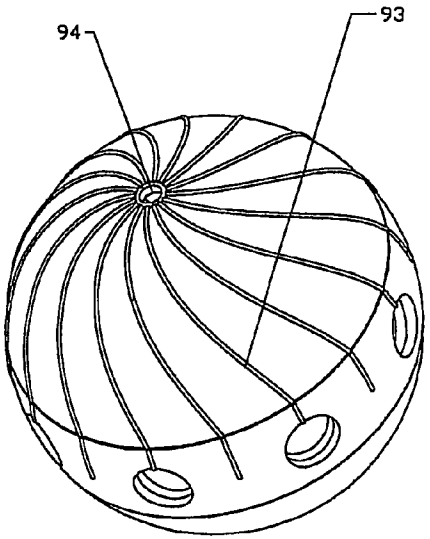
FIG. 20 is a perspective view of an alternative game ball with surface modification substantially perpendicular to the ring edge.

As shown in FIG. 20, the perpendicular ridges may converge in a circle, or as shown in FIG. 22 on another shape, such as an octagon.

Any of the surface modifications, whether raised ridges, grooves, or depressions, can vary in length and depth, depending on the nature and amount of resistance sought for the particular game ball.

Figure 21:
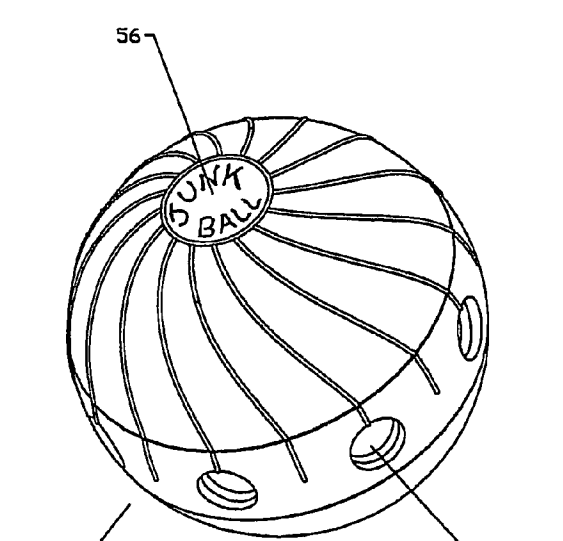
FIG. 21 is a perspective view of an alternative game ball with alternative surface modifications.
Figure 25:
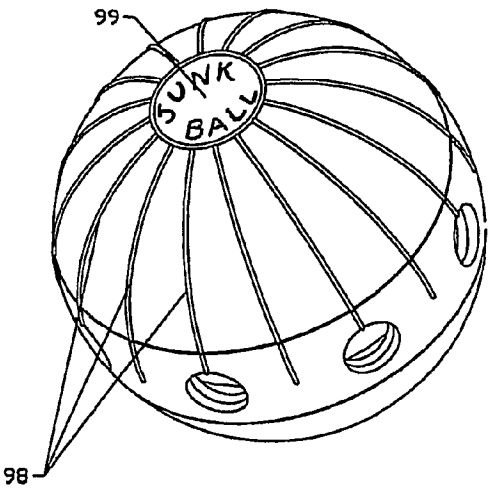
FIG. 25 is a perspective view of an alternative game ball with alternative surface modifications.
Figure 24:
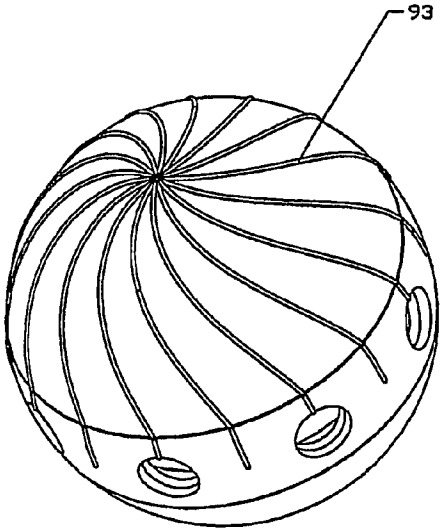
FIG. 24 is a perspective view of an alternative game ball with alternative surface modifications.
Figure 23:
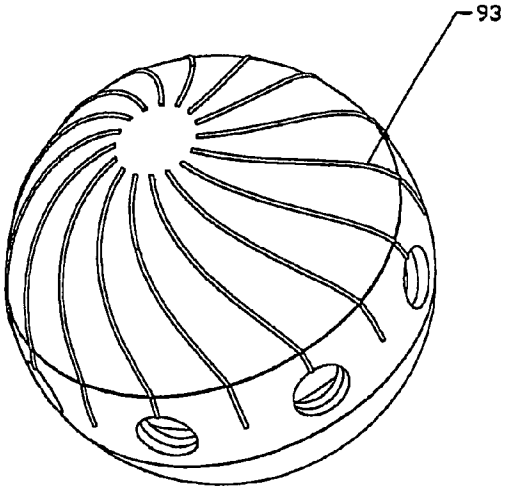
FIG. 23 is a perspective view of an alternative game ball with alternative surface modifications.
Figure 27:
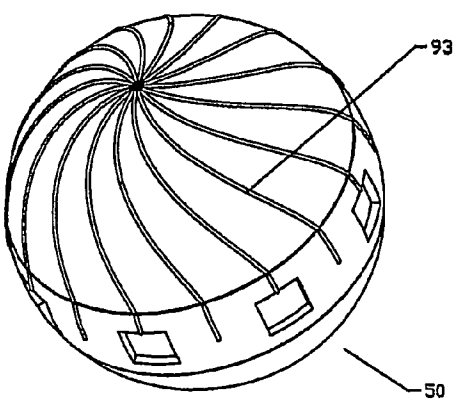
FIG. 27 is a perspective view of an alternative game ball with alternative aperture shapes.
Figure 29:
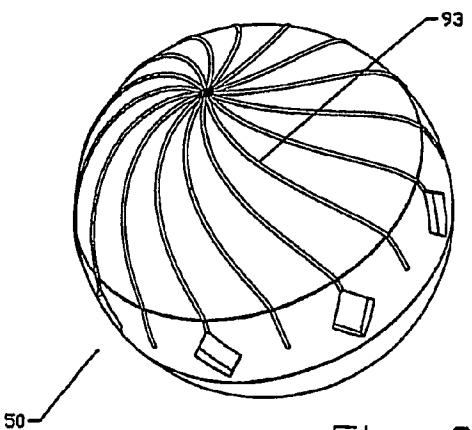
FIG. 29 is a perspective view of an alternative game ball with alternative aperture shapes.
Figure 26:
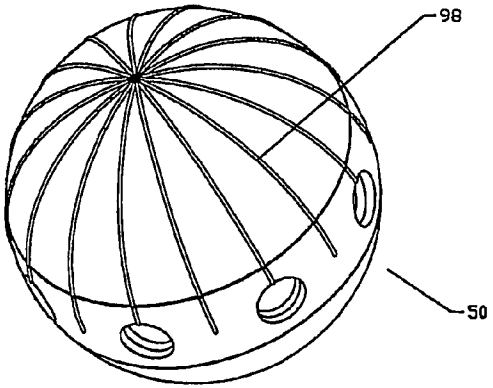
FIG. 26 is a perspective view of an alternative game ball with alternative surface modifications.
Figure 28:
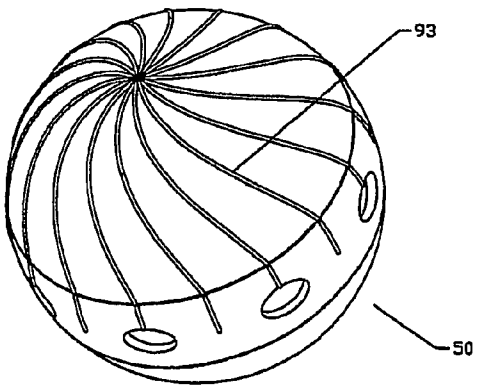
FIG. 28 is a perspective view of an alternative game ball with alternative surface modifications and alternative aperture shape.

The surface modifications also can terminate in an elevated shape 99, as shown in FIG. 25, where the elevated shape is elevated to a level above the shell outer surface 62, in contrast to the shape around the pole 56 in FIGS. 21 & 22, where the shell outer surface 62 within the circle or another shape, is approximately the same distance from the center of the shell as the shell surface of the shell on which the perpendicular ridges are located. The magnitude of elevation above the shell surface preferably equals the elevation of the perpendicular ridges above the shell outer surface 62.

The surface modifications also can terminate at or near a pole of the game ball by intersecting with other surface modifications, as shown in FIGS. 26 through 29.

In the embodiments shown in FIGS. 36, 37, 38 & 39, the indented band occupies a much larger portion of the exterior surface of the shell, extending towards the poles. The ring extends between the indented band, and can vary in size to cover a majority of the shell outer surface 62.

Figure 37:
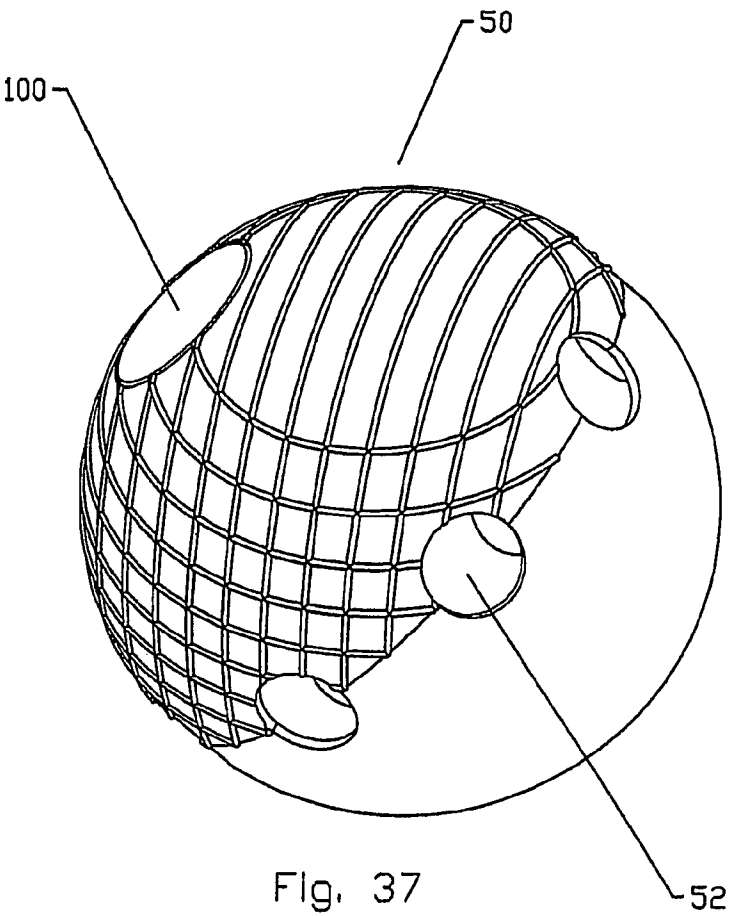
FIG. 37 is a perspective view of an alternative game ball.
Figure 36:
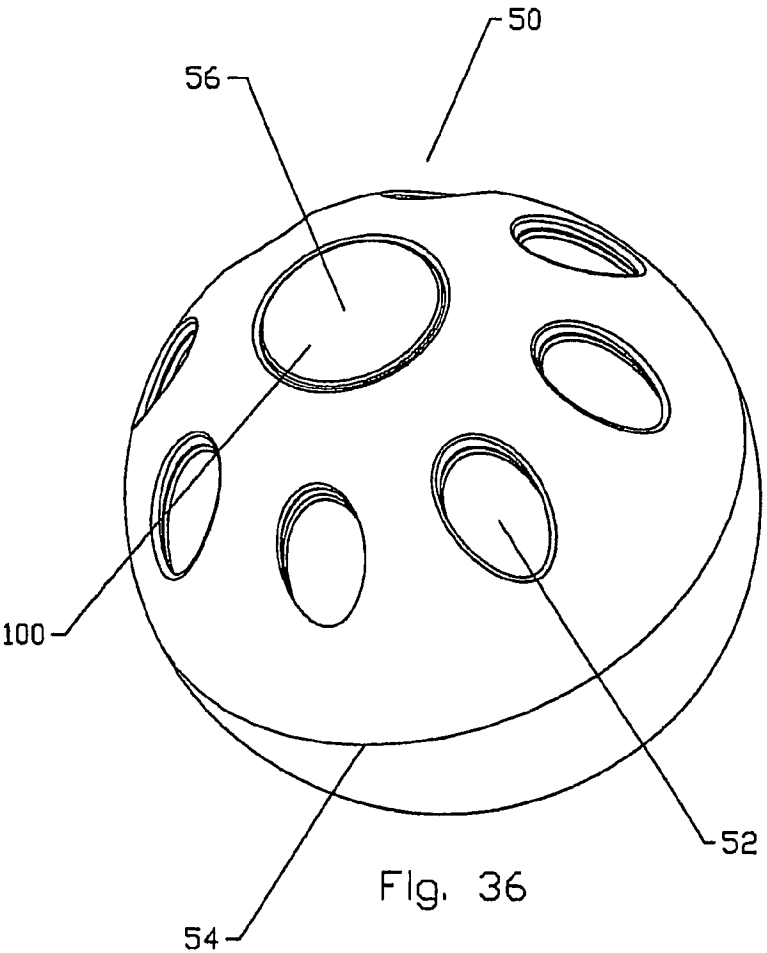
FIG. 36 is perspective view of an alternative game ball.
Figure 39:
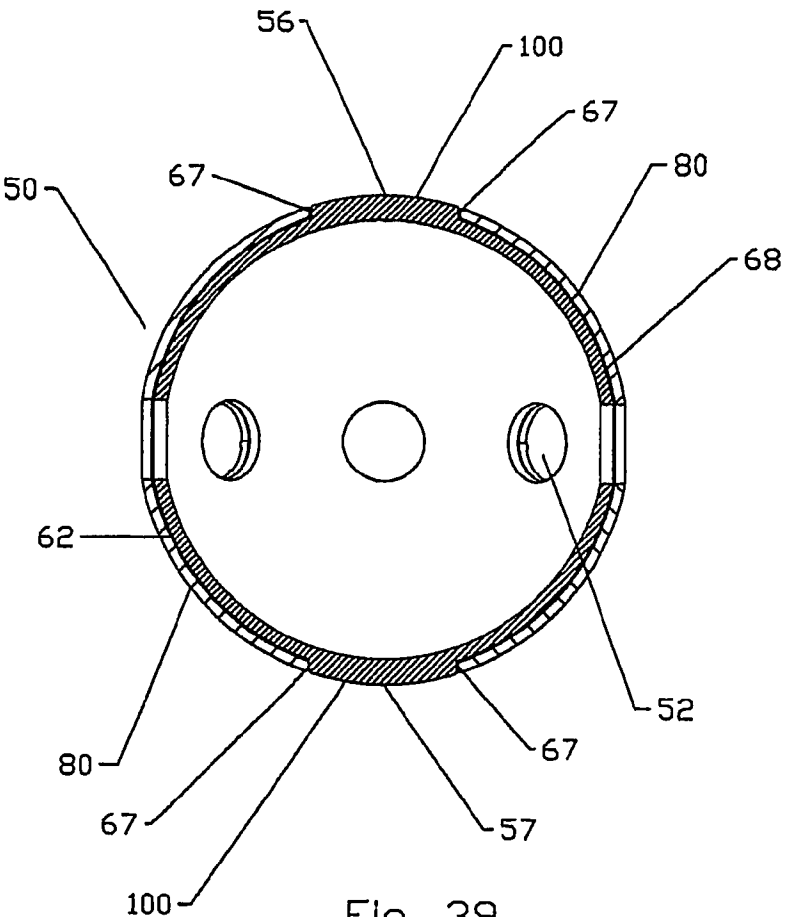
FIG. 39 is a cross-sectional view of a game ball along the A-A line in FIG. 38.
Figure 38:
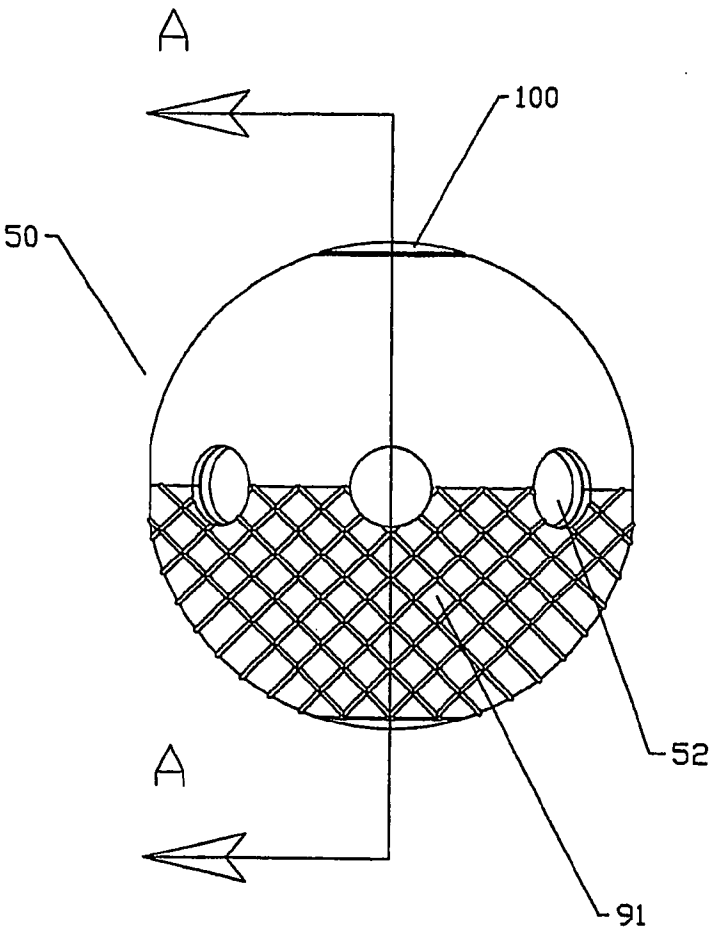
FIG. 38 is a front view of an alternative game ball.

As shown in FIG. 37, when the ring covers larger portions of the outer surface, the various surface modifications discussed above can be placed on the ring rather than the shell.

The user can adjust the adjustable openings by holding the button 100 at each pole, and rotating the ring. The shell in this embodiment is preferably blow molded in one piece, and the ring preferably is injection molded in two parts, which are then placed around the shell and spin welded. Other methods of attachment of the portions of the ring, such as solvent bonding, sonic welding, or mechanically attached, are acceptable alternatives.

Figure 31:
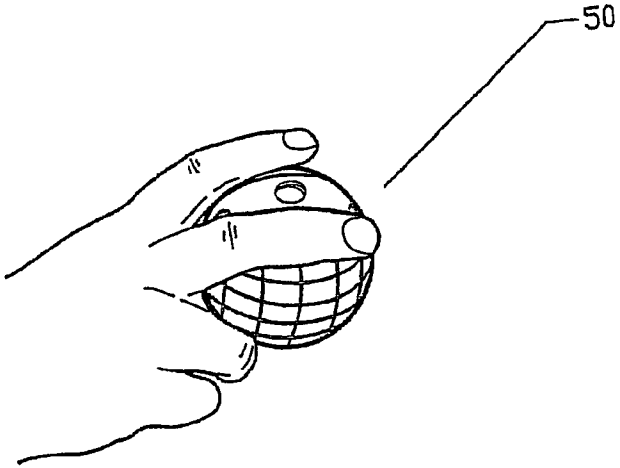
FIG. 31 is a perspective view of a user's hand gripping the game ball to throw a right curve ball.
Figure 30:
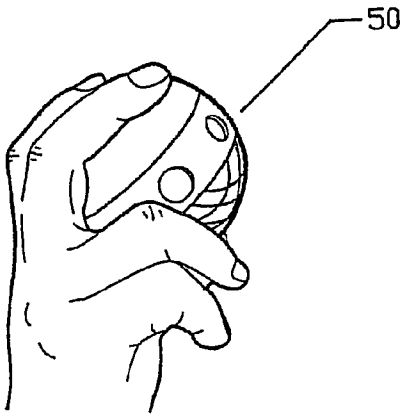
FIG. 30 is a perspective view of a user's hand gripping the game ball to throw a fast ball.
Figure 32:
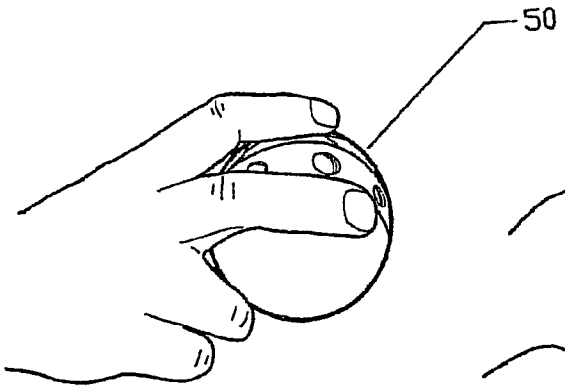
FIG. 32 is a perspective view of a user's hand gripping the game ball to throw a left curve ball.

A variety of throws or pitches can be made with the game ball. As shown in FIG. 30, a speed ball, also known as a fast ball, can be thrown by throwing overhand with the adjustable apertures closed. As shown in FIGS. 31 & 32, a curve ball can be thrown by throwing overhead, with adjustable apertures open. The ball will curve towards the direction of the air resistance, so when throwing a right curve ball, the air resistance feature such as surface modifications should be on the right, and on the left when throwing a ball curving to the left.

Figure 33:
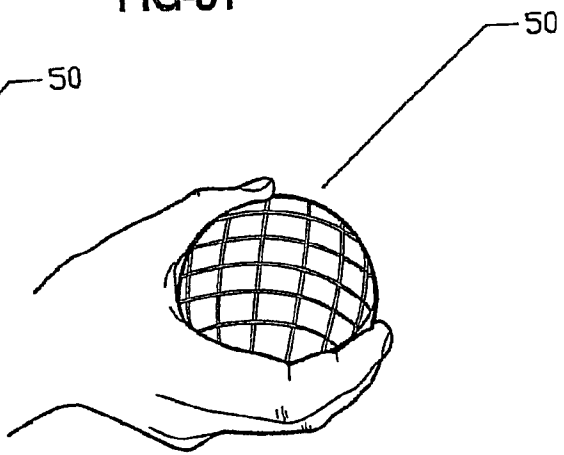
FIG. 33 is a perspective view of a user's hand gripping the game ball to throw a riser ball.
Figure 35:
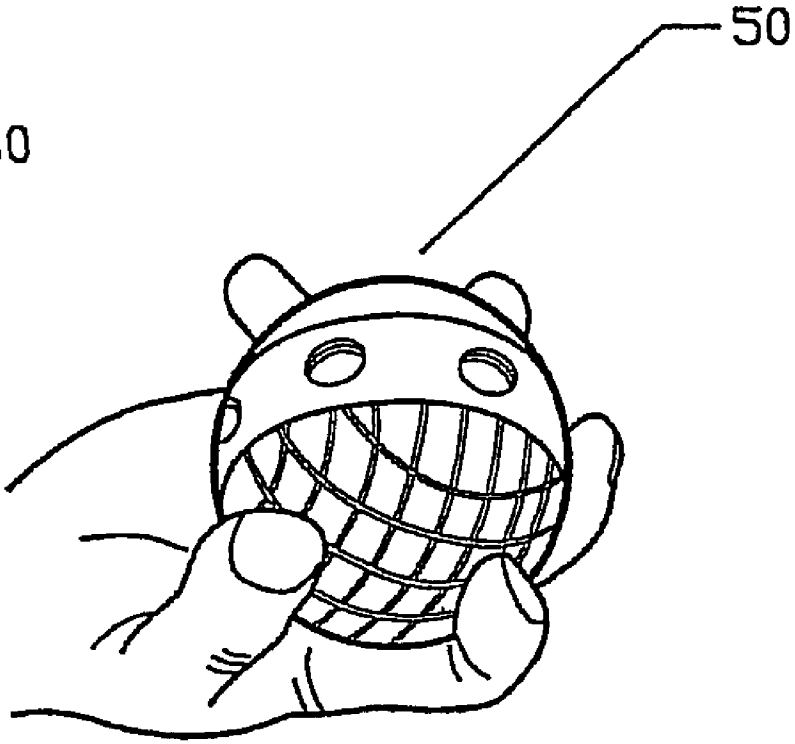
FIG. 35 is a perspective view of a user's hand gripping the game ball to throw a sinker.
Figure 34:
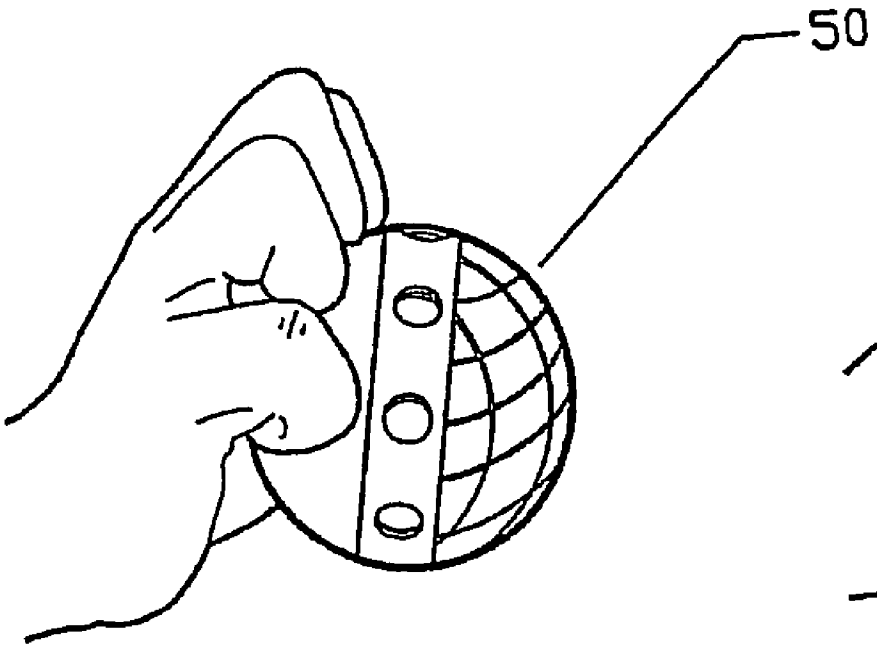
FIG. 34 is a perspective view of a user's hand gripping the game ball to throw a knuckle ball.

As shown in FIG. 33, a riser ball, in which the game ball rises, is thrown side arm, adjustable apertures open, and air resistance up. As shown in FIG. 34, a knuckle ball is thrown overhead, adjustable apertures closed, with air resistance features facing in the direction of the throw. As shown in FIG. 35, a sinker is thrown side arm, with adjustable apertures open, and the thrower's middle finger gripping the ring, and with a snap of the wrist as the ball is thrown.

Although the present invention has been described in terms of certain preferred embodiments, other embodiments will become apparent to those of skill in the art with reference to the disclosure contained herein. Accordingly, the scope of the present invention is intended not to be limited by the disclosed embodiments, but to be coextensive with the full scope of the attached claims.

We claim:

1. A game ball comprising a generally spherical shell having an outer surface and at least one adjustable aperture, where the adjustable aperture has at least one shell aperture and an adjustable component having at least one adjustable component aperture, with the adjustable component moveably connected to the shell so that the user can move the adjustable component to align the shell aperture and the adjustable component aperture.

2. The game ball of claim 1 having a locking mechanism that permits the adjustable component to be moved in stepped locked increments.

3. The game ball of claim 2 in which the locking mechanism has at least one locking protrusion and at least one locking detent so that the locking protrusion locks in the locking detent.

4. The game ball of claim 1 in which the outer surface of the shell has a substantially smooth portion and an irregular portion.

5. The game ball of claim 4 in which the adjustable component separates the substantially smooth portion from the irregular portion.

6. The game ball of claim 4 in which the irregular portion has at least one surface modification.

7. A game ball comprising: a generally spherical shell having a shell interior, a shell exterior, an outer surface, and at least one shell aperture; and a ring moveably attached to the shell, the ring having at least one ring opening, so that when the user moves the ring relative to the shell, the shell aperture can be aligned with the ring opening to permit air communication between the shell interior and the shell exterior through the shell aperture aligned with the ring opening.

8. The game ball of claim 7 in which the shell has an indented band sized to fit the ring.

9. The game ball of claim 7 having a locking mechanism that permits the ring to be moved in stepped locked increments.

10. The game ball of claim 9 in which the locking mechanism has at least one locking protrusion and at least one locking detent so that the locking protrusion locks in the locking detent.

11. The game ball of claim 7 in which the outer surface of the shell has a substantially smooth portion and an irregular portion.

12. The game ball of claim 11 in which the ring separates the substantially smooth portion from the irregular portion.

13. The game ball of claim 11 in which the irregular portion has at least one surface modification.

14. The game ball of claim 7 in which the ring has at least one retaining rib and the shell has at least one retaining rib groove, and the retaining rib groove provides resistance to the retaining rib to assist in holding the ring on the shell.

15. The game ball of claim 7 in which the ring has a substantially smooth portion and an irregular portion.

16. The game ball of claim 15 in which the irregular portion has at least one surface modification.

* * * * *